US006622620B1

(12) United States Patent
Byington

(10) Patent No.: US 6,622,620 B1
(45) Date of Patent: Sep. 23, 2003

(54) TREE COMPRESSION AND BINDING APPARATUS

(76) Inventor: Shain Byington, 12125 N. 175 East, Ririe, ID (US) 83443

( * ) Notice: Subject to any disclaimer, the term of this patent is extended or adjusted under 35 U.S.C. 154(b) by 0 days.

(21) Appl. No.: 10/212,902

(22) Filed: Aug. 5, 2002

(51) Int. Cl.[7] ..... B65B 13/10; B65B 11/00

(52) U.S. Cl. ..... 100/13; 100/27; 53/588

(58) Field of Search ..... 100/1, 3, 5, 8, 100/13, 16, 25, 26, 27; 53/528, 556, 529, 530, 588, 439, 589; 56/341

(56) References Cited

U.S. PATENT DOCUMENTS

| | | | | | |
|---|---|---|---|---|---|
| 2,974,457 | A | * | 3/1961 | Saxton | 100/13 |
| 5,421,140 | A | * | 6/1995 | Theriault | 53/530 |
| 5,878,555 | A | * | 3/1999 | Turfan et al. | 53/588 |
| 2002/0148365 | A1 | * | 10/2002 | Squyres | 100/2 |

* cited by examiner

*Primary Examiner*—Allen Ostrager
*Assistant Examiner*—Jimmy T Nguyen
(74) *Attorney, Agent, or Firm*—Hopkins Roden Crockett Hansen & Hoopes, PLLC

(57) ABSTRACT

The invention is an apparatus for laterally engaging a standing tree, compressing branches of the tree toward its trunk, and binding the branches while the branches are compressed. The apparatus includes: a support structure attached to a rigid arcuate frame, the frame partially circumscribing a vertical channel occupiable by the tree and having a horizontal channel through which the tree enters into the vertical channel when the tree is laterally engaged for baling; an assembly for compressing branches of the tree; a horizontal arcuate guide rotatably mounted to the frame; an assembly for rotating the guide around the vertical channel; and an assembly for binding branches of the tree. The apparatus may further include: an assembly for selectively gating the horizontal channel; and an assembly for guiding the trunk through the horizontal channel and deflecting branches during lateral engagement.

15 Claims, 10 Drawing Sheets

TREE COMPRESSION AND BINDING APPARATUS

TECHNICAL FIELD

This invention relates to an apparatus for laterally engaging a standing tree, compressing branches of said tree toward the trunk of said tree and baling said branches around said trunk by helically arrayed binding means while said branches are thus compressed.

BACKGROUND OF THE INVENTION

Tree baling refers to a process of bundling extended branches of a tree tightly about its trunk to compress the girth of said tree. Various tree baling devices are used in industries where trees are shipped with their branches still attached. Baling allows trees to be more densely packed during transport and serves a protective function by minimizing potentially damaging interaction between tree branches and other objects during transport.

Although multiple tree baling devices have been used, comparatively few are capable of baling a tree in its naturally standing state. Inability to bale a tree in its naturally standing state carries several disadvantages. For example, nursery or stock trees intended for replanting cannot be cut and hauled through a horizontal baler. Christmas trees that are cut must be baled within a short time of the Christmas season or they will lose their needles. Concentrating baling in such a brief time period typically requires more equipment and manpower than would be the case if trees could be baled over a longer period. Moreover, falling or harvesting an unbaled tree with its outstretched branches and moving it to a baling or transport mechanism not only requires more effort but also increases likelihood of damage as the outstretched branches and limbs interact with other objects.

While various tree baling and other similar devices disclosed in U.S. Pat. No. 4,939,989, U.S. Pat. No. 4,619,193 and U.S. Pat. No. 2,787,634 include some of the general structural and operational features of the instant invention, no previously known device includes the overall structural and functional features of the instant invention. These overall structural and functional features promote efficiency, simplicity and ease of operation and allow the present invention to laterally engage about the lower portion of a tree to be baled as opposed to either: (1) being initially engaged with a tree to be baled by lowering the apparatus downwardly over said tree; or (2) initially having a plurality of arcuate or other shiftable frame, collar or yoke members horizontally constricted about said tree.

The present invention further offers the advantage, strength and stability of a rigid, solid frame without the complexity or cost associated with an apparatus having a plurality of arcuate or other frame sections and associated means for moving those multiple sections. The strength and stability of a solid frame are of particular utility when the baling project—for instance in the case of a large tree—presents a probability of comparatively larger forces being exerted by the object to be baled against the baling apparatus.

SUMMARY OF THE INVENTION

It is an object of this invention to provide an apparatus for laterally engaging a standing tree, compressing branches of said tree toward the trunk of said tree and baling said branches around said trunk by helically arrayed binding means while said branches are thus compressed. The apparatus comprises: a support structure rigedly attached to a substantially arcuate frame, said arcuate frame being generally oriented in a horizontal plane during standard operation, said arcuate frame partially circumscribing a vertical channel occupiable by a tree being baled and said arcuate frame further having a horizontal channel through which said tree enters into said vertical channel when said tree is laterally engaged for baling and through which said tree exits at the conclusion of baling; means for compressing branches of said tree toward said trunk of said tree; a horizontal arcuate guide operatively connected to said arcuate frame; means for rotating said arcuate guide in an orbit around said vertical channel; and means for binding branches of said tree around its trunk while said branches are compressed. In various preferred embodiments, the apparatus further comprises: means for selectively gating said horizontal channel; means for guiding said trunk through said horizontal channel and displacing branches of said tree from the horizontal path of said apparatus during lateral engagement of said apparatus around said tree.

Another object of this invention is to provide an apparatus in accordance with the preceding paragraph which is capable of being laterally engaged about a lower portion of the tree to be baled as opposed being initially engaged with said tree by lowering the apparatus downwardly over said tree.

Another object of this invention is to provide an apparatus which is capable of being laterally engaged about the lower portion of the tree to be baled as opposed to initially having a plurality of arcuate or other shiftable frame, collar or yoke members horizontally constricted about said tree.

Another object of this invention is to provide an apparatus with the strength and stability of a rigid, solid and continuous frame as opposed to an apparatus having a plurality of shiftable frame members.

Another object of this invention is to provide a tree baling apparatus in accordance with the preceding objects and which will conform to conventional forms of manufacture, be of comparatively simple construction and easy to use so as to provide a device that will be economically feasible, long lasting and relatively free of trouble in operation.

These together with the other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
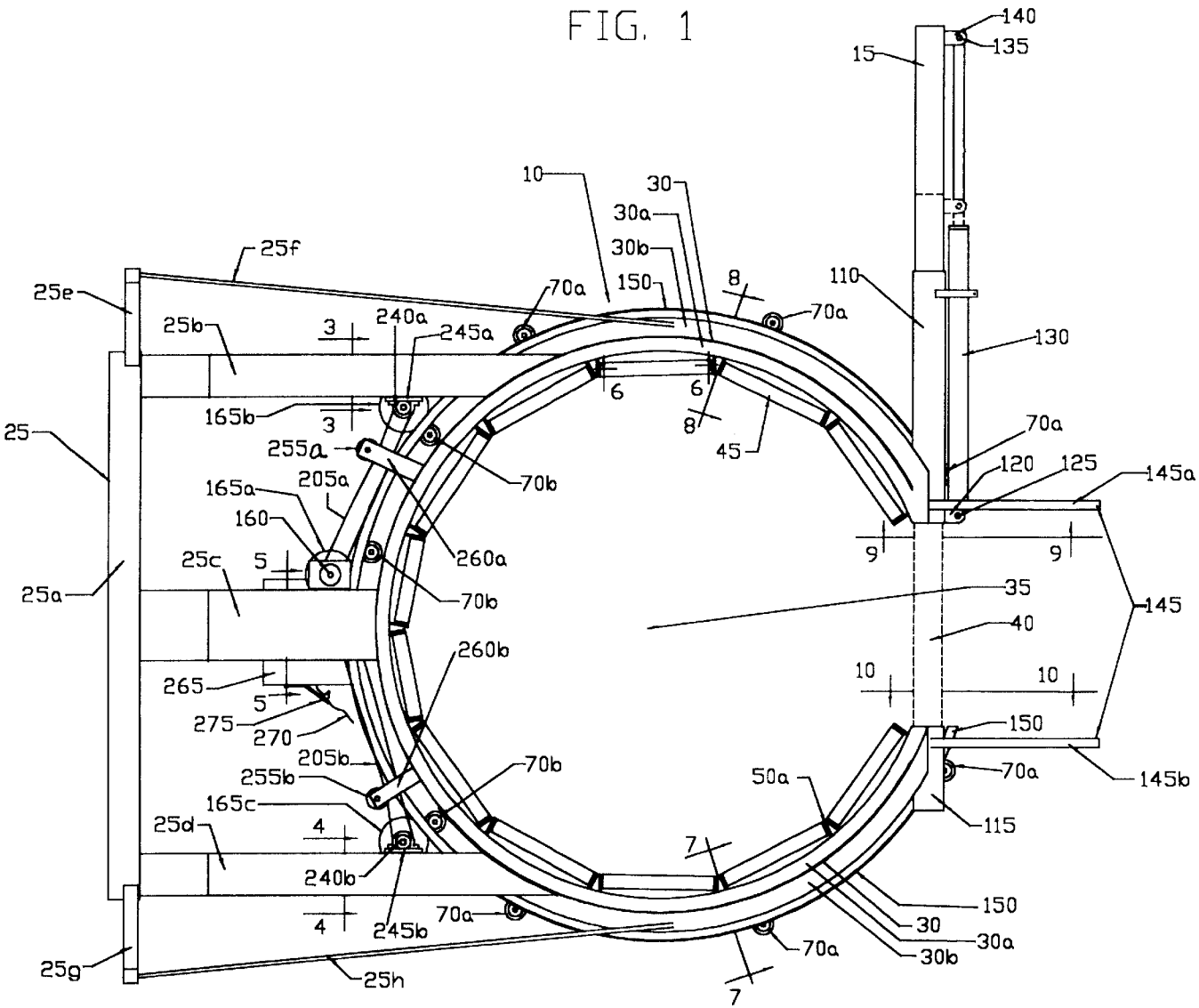
FIG. 1 is a top plan view of the tree compression and binding apparatus of the present invention with a gate shown in open position by solid lines and with said gate shown in closed position by phantom lines.

FIG. 1 illustrates a preferred embodiment of a tree compression and binding apparatus 10, with a gate 15 shown by solid lines in an opened position and by phantom lines in a closed position. In standard operation, said apparatus 10 is operatively connected with a lifting device comprising a liftable portion of a lift truck, a skid steer loader, a forklift, a wheel loader, a tractor, a backhoe, a trackhoe or other equivalent means for lifting said apparatus 10, said lifting device referred to in general by numeral 20 in FIG. 12.

Figure 2:
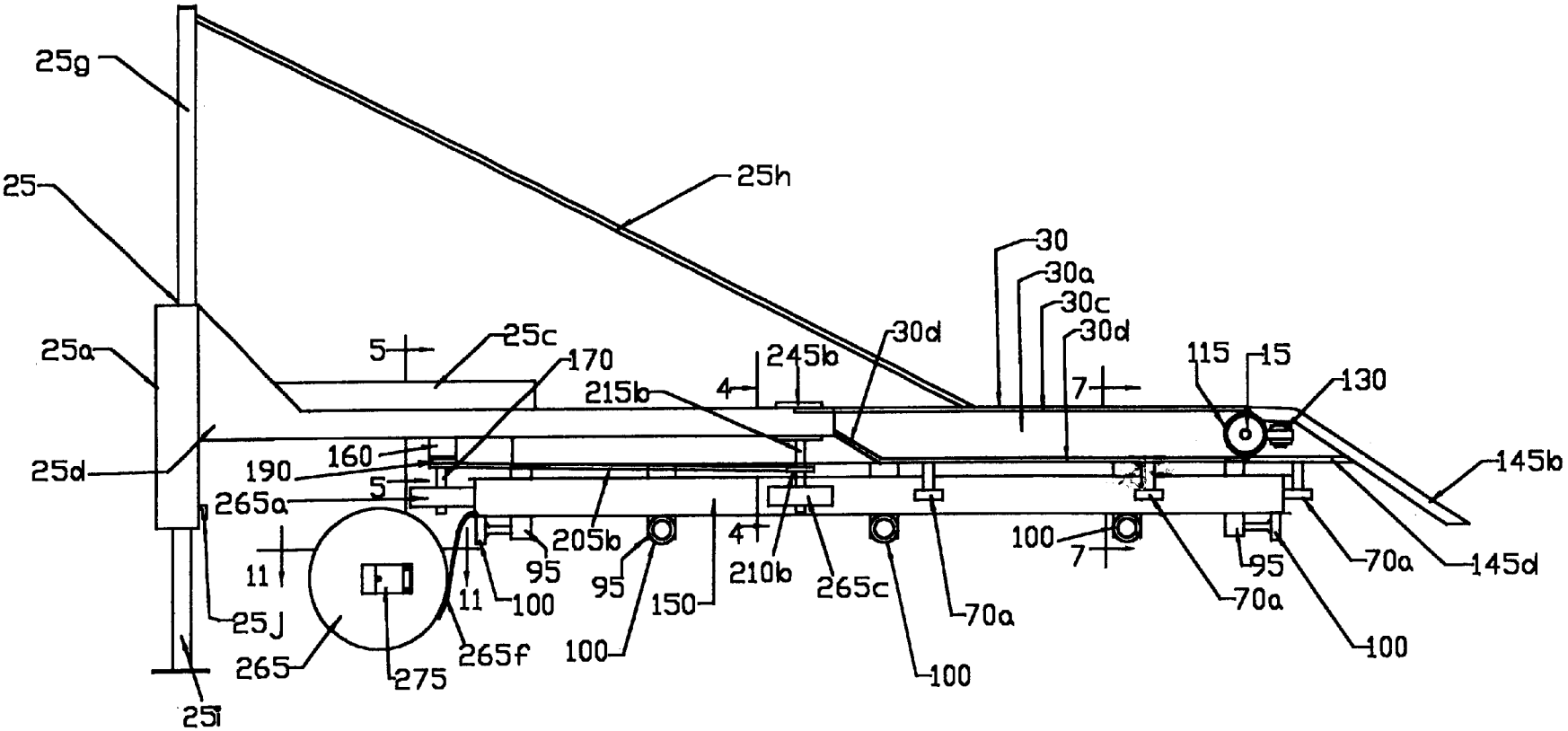
FIG. 2 is an elevated horizontal plan view from the right of the tree compression and binding apparatus of the present invention.

Further shown in FIGS. 1 and 2 is a preferred embodiment of a support structure 25 of said apparatus 10 having a back member 25*a*, a left horizontal support member 25*b* rigidly connected to said back member 25*a* at an attachment area within the left one-third of said back member 25*a*, a center horizontal support member 25*c* rigidly connected to said back member 25*a* at an attachment area within the center one-third of said back member 25*a*, a right horizontal support member 25*d* rigidly connected to said back member 25*a* at an attachment area within the right one-third of said back member 25*a*, a left upper support member 25*e* rigidly connected to said back member's top at a first attachment area located within the left one-half of said back member 25*a* and rigidly connected at another connection above said first attachment area to one end of a left diagonal support member 25*f*, and a right upper support member 25*g* rigidly connected to said back member 25*a* at a second attachment area located within the right one-half of said back member and rigidly connected at another connection above said second attachment area to one end of a right diagonal support member 25*h*. A parking leg support member 25*i* is slidingly insertable into a vertical parking leg channel (not shown) extending upward from the bottom perimeter of said back member 25*a*, said parking leg support member being attachable in a rigid configuration in said parking leg channel by means of a parking leg pin 25*j* insertable through a horizontal parking leg pin hole (not shown), said parking leg pin hole extending radially outward from said parking leg channel. The lifting device 20 attaches to the back member 25*a*, said back member 25*a* being custom built to operatively connect with the lifting device 20 to be associated.

A rigid arcuate frame 30 operatively connects with said support structure 25. In a preferred embodiment of the invention illustrated in FIGS. 1 and 2, said arcuate frame 30 rigidly connects to said support structure in a plurality of locations, including: an end of said left horizontal support member 25*b* opposite said left horizontal support member's connection with said back member 25*a*; an end of said center horizontal support member 25*c* opposite said center horizontal support member's connection with said back member 25*a*; and an end of said right horizontal support member 25*d* opposite said right horizontal support member's connection with said back member 25*a*.

Said arcuate frame 30 partially circumscribes a vertical channel 35 occupiable by a standing tree being baled and said arcuate frame further has a horizontal channel 40, through which said tree enters into said vertical channel 35 when said tree is laterally engaged for baling and through which said tree exits at the conclusion of baling. With attention directed to FIGS. 1, 2, 7 and 8, it may be seen that in a preferred embodiment of the invention, a single main body 30*a* of said arcuate frame 30 is reinforced by a plurality of arcuate frame reinforcement members 30*b*, 30*c*, 30*d*, 30*e* rigidly connected to the outer perimeter of said main body 30*a* of said arcuate frame 30. In the preferred embodiment shown in FIGS. 1 and 8, an upper left arcuate frame reinforcement member 30*b* rigidly connects to, and extends along a portion of the upper aspect of the outer perimeter of said main body's left side. Further referring to FIGS. 1, 2 and 7, an upper right arcuate frame reinforcement member 30*c* likewise rigidly connects to, and extends along a portion of the upper aspect of the outer perimeter of said main body's right side. Further referring to a preferred embodiment shown in FIGS. 2 and 7, a lower right arcuate frame reinforcement member 30*d* rigidly connects to, and extends along a portion of the lower aspect of the outer perimeter of said main body's right side. As seen in FIG. 8, a lower left arcuate frame reinforcement member 30*e*, likewise rigidly connects to, and extends along a portion of the lower aspect of the outer perimeter of said main body's left side. In one preferred embodiment set forth in FIGS. 7 and 8, said main body 30*a* of said arcuate frame 30 comprises a metallic rectangular tube.

Referring to a preferred embodiment illustrated in FIG. 1, said upper left arcuate frame reinforcement member 30*b* rigidly connects to an end of the left diagonal support member 25*f* opposite said left diagonal support member's connection with said left upper support member 25*e*, and said left diagonal support member 25*f* extends diagonally downward and inward from its connection with said left upper support member 25*e* to its connection with said upper left arcuate frame reinforcement member 30*b*. In the same embodiment, the upper right arcuate frame reinforcement member 30*c* likewise rigidly connects to an end of said right diagonal support member 25*h* opposite said right diagonal support member's connection with said right upper support member 25*g*, and said right diagonal support member extends 25*h* diagonally downward and inward from its connection with said right upper support member 25*g* to its connection with said upper right arcuate frame reinforcement member 30*c*.

Figure 6:
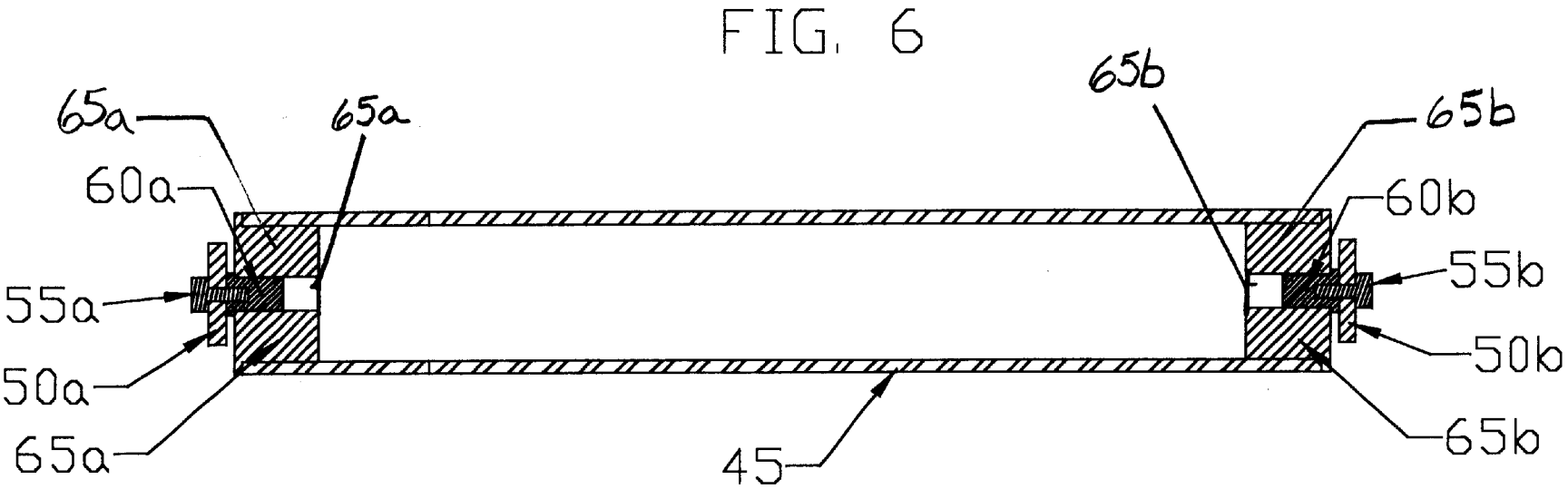
FIG. 6 is a sectional view taken through line 6—6 of FIG. 1.
Figure 7:
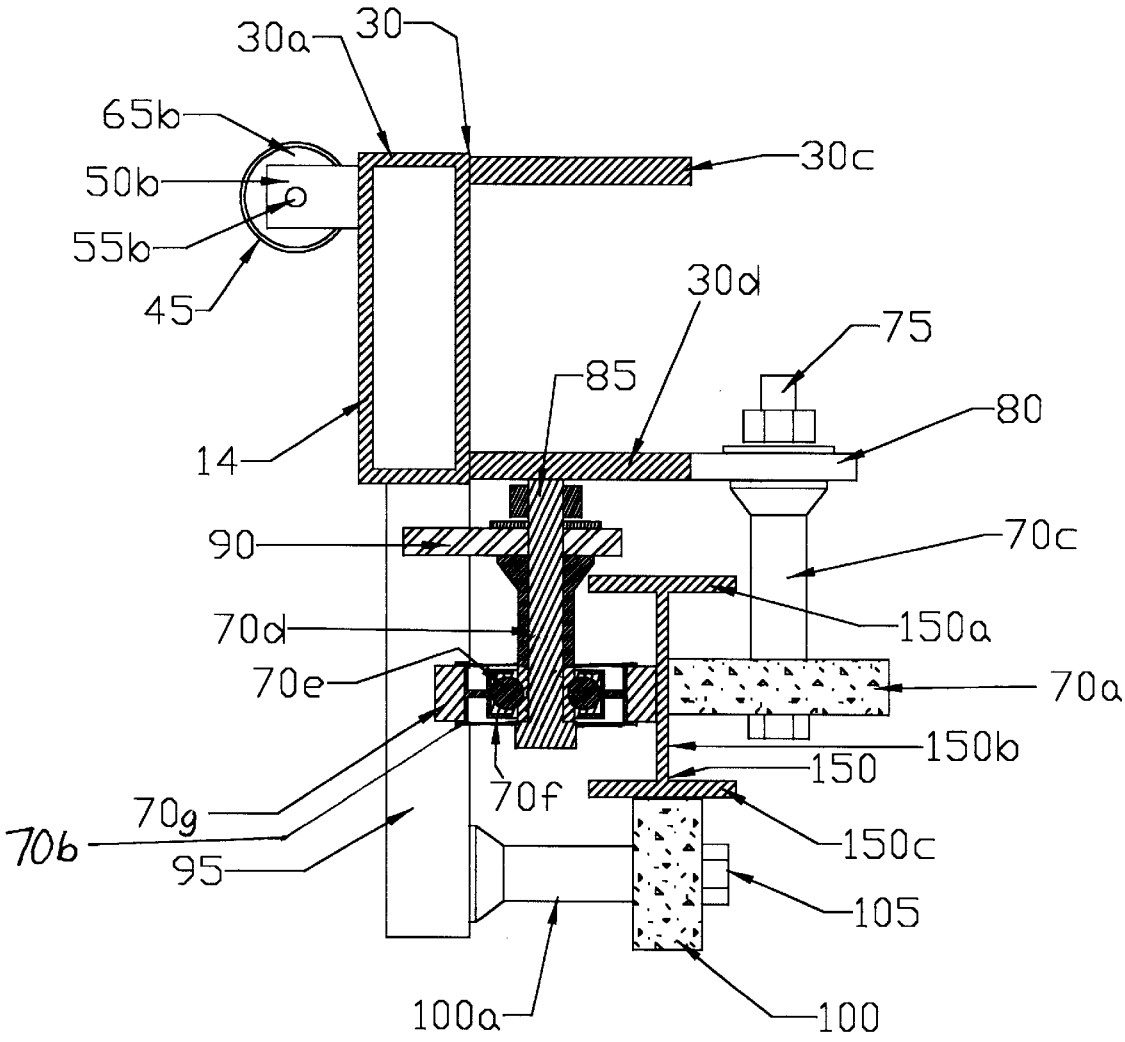
FIG. 7 is a sectional view taken through line 7—7 of FIG. 1 and line 7—7 of FIG. 2.
Figure 8:
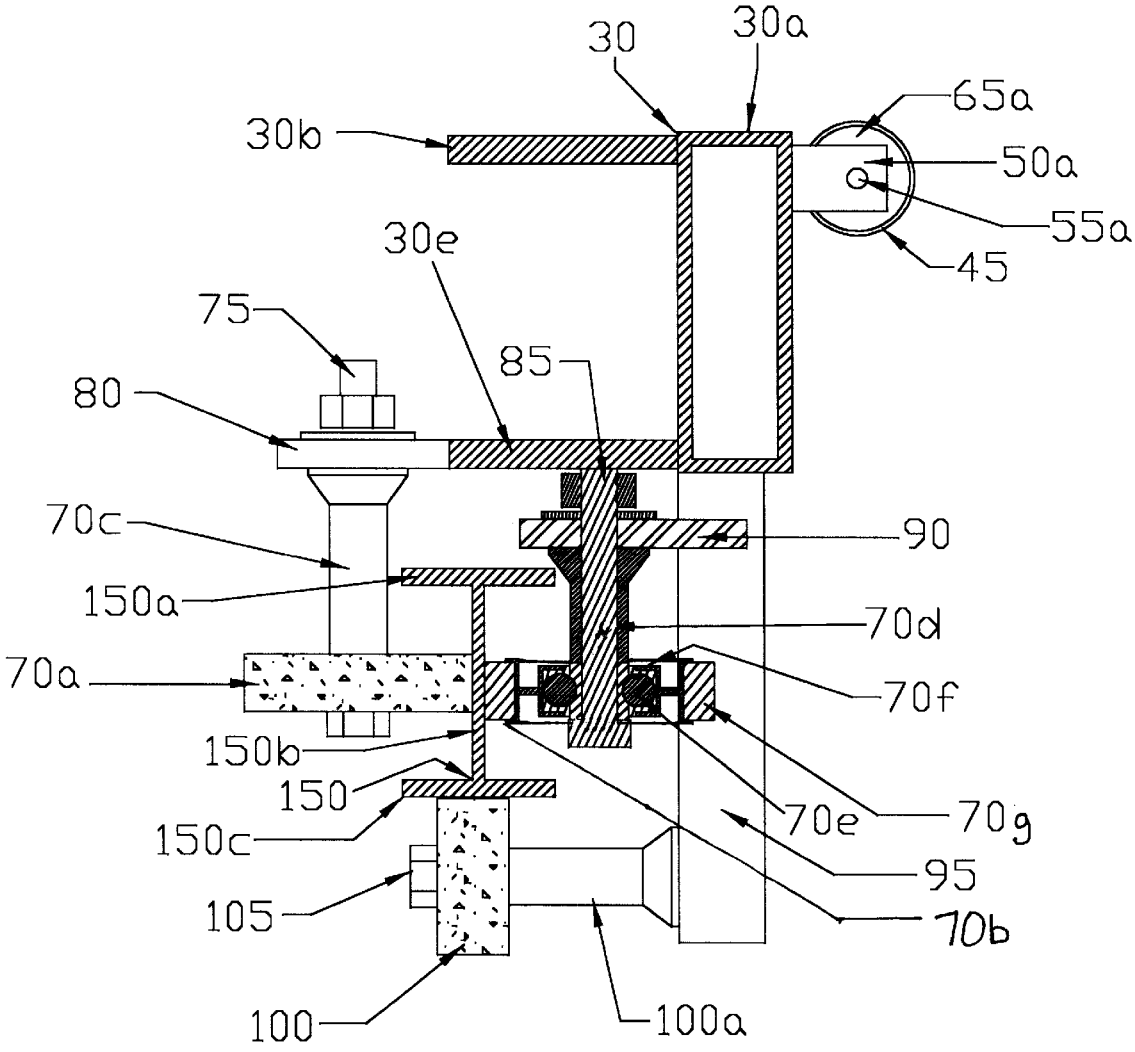
FIG. 8 is a sectional view taken through line 8—8 of FIG. 1.
Figure 9:
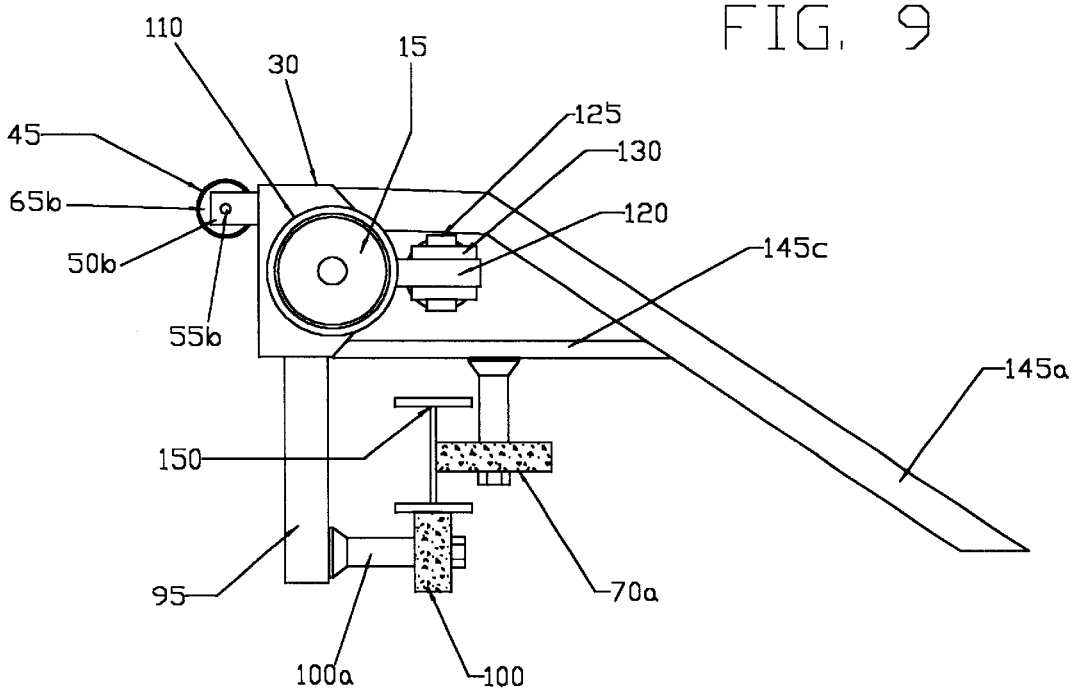
FIG. 9 is a sectional view taken through line 9—9 of FIG. 1.
Figure 10:
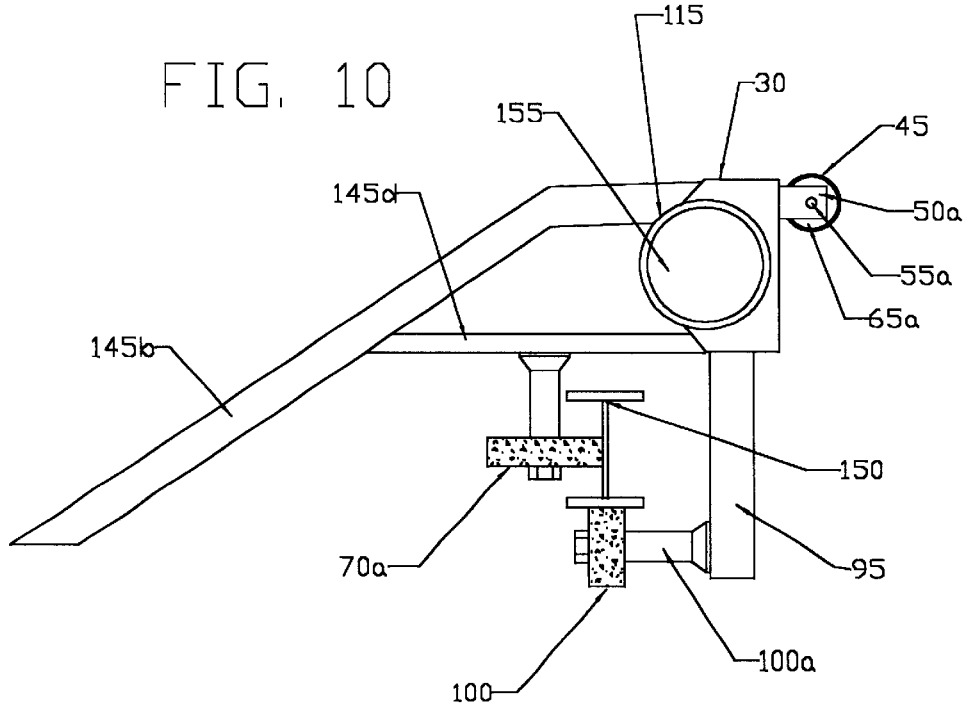
FIG. 10 is a sectional view taken through line 10—10 of FIG. 1.

FIGS. 6, 7 and 8 further illustrate an assembly and means for compressing a plurality of branches of said standing tree toward said trunk of said tree, said assembly and means for compressing comprising a plurality of cylindric horizontal rotatable compression rollers 45 forming an open-sided and partially polygonal array spaced to the interior side of the interior perimeter of said arcuate frame 30, said compression rollers 45 being rotatable and operatively connected to said arcuate frame 30. During standard operation, each compression roller among said plurality of compression rollers 45 is rotatable around a horizontal axis.

Referring more specifically to a preferred embodiment set forth in FIGS. 6, 7 and 8, each compression roller among said plurality of compression rollers 45 is rotatably connected at a first end with a first spinner tab 50*a* by means of a first compression roller bolting mechanism 55*a* inserted through a hole in said first spinner tab 50*a* and boltedly connected to a first bearing insert 60*a* in a first compression roller insert 65*a*, said first compression roller insert 65*a* being attached to an end of said compression roller 45. Said first spinner tab 50*a* proceeds outward from its rotatable connection with said first compression roller bolting mechanism 55*a* in a direction perpendicular to the horizontal axis of said compression roller 45 and in the same horizontal plane as said compression roller 45 and rigidly connects with said arcuate frame 30 at an attachment area on the interior perimeter of said arcuate frame 30.

Further referring to the embodiment set forth in FIGS. 6, 7 and 8, each compression roller among said plurality of compression rollers 45 is likewise rotatably connected at an opposite end to a second spinner tab 50*b* by means of a second compression roller bolting mechanism 55*b* inserted through a hole in said second spinner tab 50*b* and boltedly connected to a second bearing insert 60*b* in a second compression roller insert 65*b*, said second compression roller insert 65*b* being attached to an end of said compression roller 45. Said second spinner tab 50*b* proceeds outward from its rotatable connection with said second compression roller bolting mechanism 55*b* in a direction perpendicular to the horizontal axis of said compression roller 45 and in the same horizontal plane as said compression roller 45 and rigidly connects with said arcuate frame 30 at an attachment area on the interior perimeter of said arcuate frame 30.

Referring to FIGS. 1 and 2, a plurality of external guide rollers 70*a* and a plurality of internal guide rollers 70*b* occupy various points on two parallel arcuate paths beneath said arcuate frame 30 and are each operatively connected to said arcuate frame 30. Referring more specifically to the embodiment set forth in FIGS. 6, 7 and 8, each external guide roller among said plurality of external guide rollers 70*a* is rotatably connected to a vertical external guide bolting mechanism 75 inserted through a hole (not shown) in a horizontal external guide mounting bracket 80, with said external guide mounting bracket 80 proceeding radially inward from said hole therein and being rigidly connected at an inner end of said external guide mounting bracket 80 to the exterior perimeter of said arcuate frame 30 at either the exterior perimeter of said lower arcuate frame reinforcement members 30*d*, 30*e* (as shown in said FIGS. 7 and 8) or, alternatively, to the exterior perimeter of the main body 30*a* of said arcuate frame 30 for portions of said arcuate frame 30 where no associated arcuate frame reinforcement member exists. Each external guide roller among said plurality of external guide rollers 70*a* is rotatable around a vertical axis and spaced from said external guide mounting bracket 80 by an external guide roller spacer 70*c*.

Referring further to the embodiment set forth in FIGS. 7 and 8, each internal guide roller among said plurality of internal guide rollers 70*b* is rotatably connected to a vertical internal guide bolting mechanism 85 inserted through a hole in a horizontal internal guide mounting bracket 90, with said internal guide mounting bracket 90 proceeding radially inward from said hole therein and rigidly connecting to a vertical carrier mounting bracket 95, said carrier mounting bracket 95 proceeding upward in a vertical direction from its connection with said internal guide mounting bracket 90 and rigidly connecting to the lower perimeter of said arcuate frame 30. Each internal guide roller among said plurality of internal guide rollers 70*b* is rotatable around a vertical axis and spaced from said internal guide mounting bracket 90 by an internal guide roller spacer 70*d*. In one preferred embodiment noted in FIGS. 7 and 8, each of said internal guide rollers among said plurality of internal guide rollers comprises a plurality of ball bearings 70*e* rotatably engaged with a roller wheel frame 70*f*, said roller wheel frame 70*f* being disposed radially outward therefrom and rigidly attaching at said roller wheel frame's outer perimeter to a guide engaging roller member 70*g*, said guide engaging roller member 70*g* being rotatable around a vertical axis.

Referring further to FIGS. 2, 7 and 8, a plurality of carrier rollers 100 are disposed at various points on an arcuate path beneath said arcuate frame 30, and are each operatively connected to said arcuate frame 30. Referring to the embodiment set forth in FIGS. 7 and 8, each carrier roller among said plurality of carrier rollers 100 is rotatably connected to a horizontal carrier bolting mechanism 105 inserted through a hole (not shown) in said carrier roller 100 and boltedly connected to the carrier mounting bracket 95, said carrier mounting bracket 95 proceeding upward in a vertical direction from its connection with said carrier bolting mechanism 105 and rigidly connecting at an upper perimeter of said carrier mounting bracket 95 to the lower perimeter of said arcuate frame 30. Each carrier roller among said plurality of carrier rollers 100 is rotatable around a horizontal axis and spaced from said carrier mounting bracket 95 by a carrier roller spacer 100*a*.

In various preferred embodiments of the invention, said arcuate frame 30 is operatively connected to an assembly and means for selectively gating said horizontal channel 40. In a preferred embodiment set forth in FIGS. 1, 2, 9 and 10, a tubular horizontal gate sleeve 110, disposed laterally away from said horizontal channel 40, having a gate passageway therethrough and further having an end bordering said horizontal channel 40, rigidly attaches along its outer perimeter to an area on the external perimeter of said arcuate frame 30 bordering said horizontal channel 40 and extends away from that border of said horizontal channel 40. On the opposite side of said horizontal channel 40, a tubular horizontal gate coupling sleeve 115 disposed laterally away from said horizontal channel 40, having a gate coupling passageway 155 therethrough and further having an end bordering said horizontal channel 40, likewise rigidly attaches along its outer perimeter to an area on the external perimeter of said arcuate frame 30 bordering said horizontal channel 40 and extends away from that border of said horizontal channel 40.

Said horizontal gate sleeve 110 rigidly connects to a first ram tab 120 having a hole therein and through which hole a first ram pin 125 connects to a horizontal hydraulic ram 130. Said hydraulic ram 130 extends laterally away from said horizontal channel 40 in a direction substantially parallel to that of said horizontal gate sleeve 110 to a second connection by means of a second ram pin 135 with a second ram tab 140. Said second ram tab 140 attaches to the horizontal gate 15, and said gate 15 extends medially toward, and then through said gate passageway of said horizontal gate sleeve 110, being so disposed that said hydraulic ram 130, when extended, maintains an open horizontal channel 40. After laterally engaging the tree to be baled, said hydraulic ram 130 may be retracted. By retracting said hydraulic ram 130, said gate 15 is drawn through said gate passageway of said horizontal gate sleeve 110, closes the horizontal channel 40, and continues into the gate coupling passageway 155 of said gate coupling sleeve 115 as shown by phantom lines in FIG. 1. Said hydraulic ram is operatively connected to a hydraulic motor associated with said lifting device 20 by means of one or more hydraulic lines (not shown) disposed along said arcuate frame 30 and said support structure 25 to an operative connection with said hydraulic motor.

In various preferred embodiments of the invention, said arcuate frame 30 is operatively connected to an assembly and means for guiding a trunk of a standing tree to be baled through said horizontal channel 40 and displacing a branch of said tree from a horizontal path in front of said apparatus 10 during lateral engagement of said apparatus 10 around said tree, said assembly and means for guiding and displacing comprising a limb guide 145 having a plurality of limb guide lifting members 145*a*, 145*b* and, in various preferred embodiments, a plurality of limb guide support members 145*c*, 145*d*. Referring to a preferred embodiment illustrated in FIGS. 1, 2, 9 and 10, a left limb guide lifting member 145*a* rigidly attaches at one of its two ends to the left forward aspect of said arcuate frame 30, extends forward and diagonally downward to an opposite end, and is supported by a left limb guide support member 145*c* that rigidly attaches at one end to said arcuate frame 30 and at an opposite end to said left limb guide lifting member 145*a*. In similar fashion, a right limb guide lifting member 145*b* rigidly attaches at one of its two ends to the right forward aspect of said arcuate frame 30, extends forward and diagonally downward to an opposite end, and is supported by a right limb guide support member 145*d* that rigidly attaches at an end to said arcuate frame 30 and at an opposite end to said right limb guide lifting member 145*d*. As the apparatus 10 is thus moved forward for lateral engagement about said tree, said trunk of said tree is guided by said limb guide 145 into said horizontal channel 40 and branches extending to both the right and to the left of said trunk of said tree are accordingly deflected over said apparatus 10.

Referring to FIGS. 1, 2, 7, 8, 9 and 10, an arcuate guide 150 having a horizontal passageway equal to or greater in horizontal dimension than the horizontal channel 40 associated with said arcuate frame 30 partially circumscribes the vertical channel 35 occupiable by said tree, is disposed upon said plurality of carrier rollers 100, and is rotatable in a complete, circular orbit around said vertical channel 35. As best seen in FIGS. 7 and 8, said arcuate guide 150 is guided in its orbit by said plurality of external guide rollers 70*a* which engage said arcuate guide's exterior perimeter at a narrow neck 150*b* between two broader ends 150*a*, 150*c* of said arcuate guide 150 and by said plurality of internal guide rollers 70*b* which engage said arcuate guide's interior perimeter at said narrow neck 150*b* of said arcuate guide 150.

Figure 3:
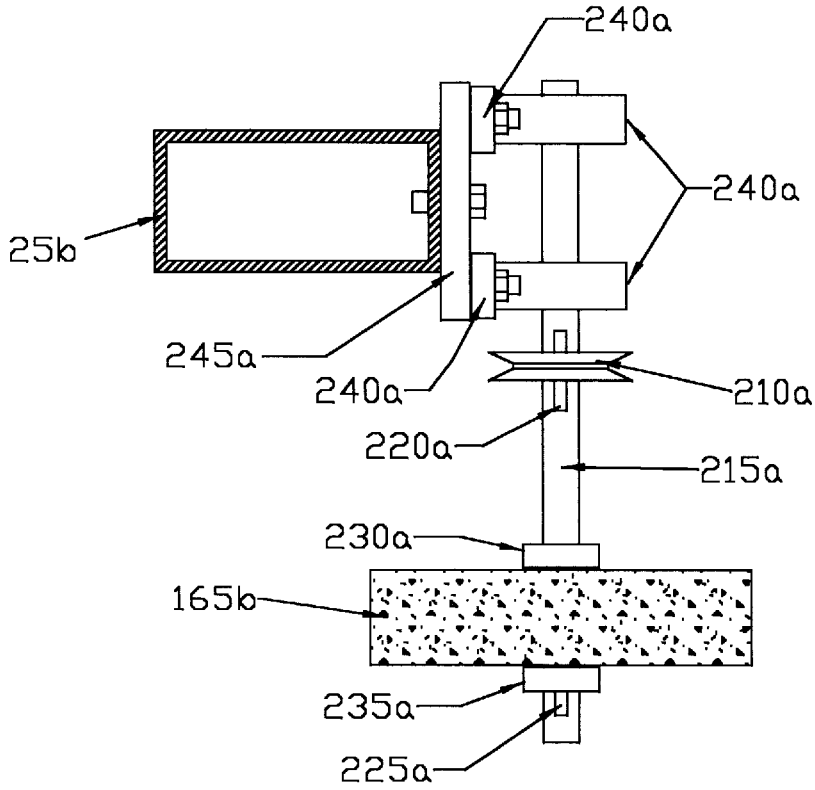
FIG. 3 is a sectional view taken through line 3—3 of FIG. 1.
Figure 4:
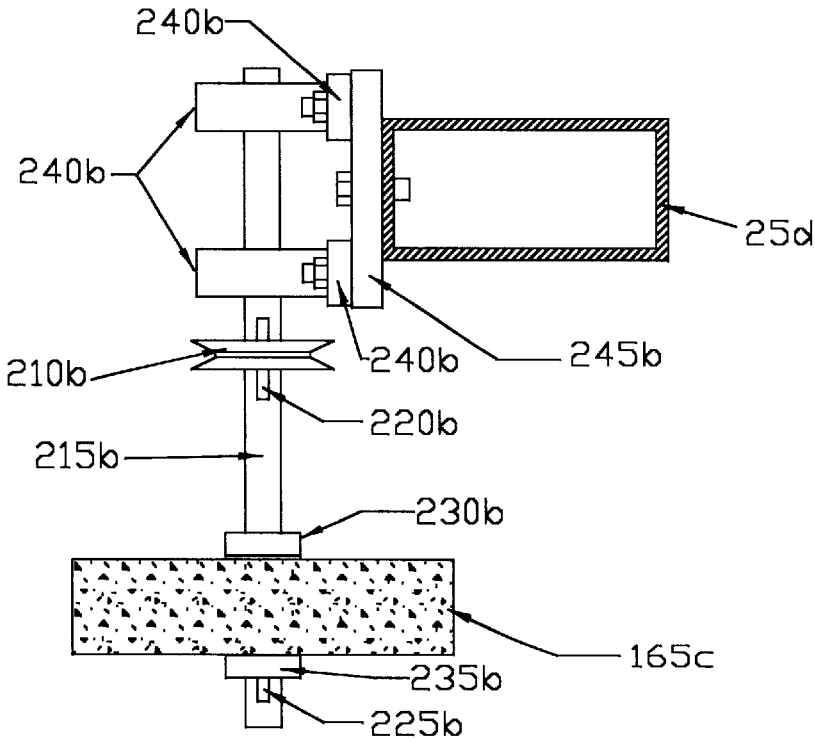
FIG. 4 is a sectional view taken through line 4—4 of FIG. 1 and line 4—4 of FIG. 2.

Said arcuate guide 150 is operatively connected to an assembly and means for rotating said arcuate guide 150 through a complete circular orbit around said vertical channel 35, said assembly and means for rotating comprising a hydraulic drive motor 160 operatively connected to a plurality of rotatable drive wheels 165*a*, 165*b*, 165*c*, said plurality of drive wheels being frictionally engagable with the perimeter of said arcuate guide 150, together with said plurality of carrier As illustrated in FIG. 1, said dual drive belt pulley 190 is beltedly connected by a left drive belt 205*a* to a left remote drive pulley 210*a* (shown in FIG. 3) and by a right rollers 100, said plurality of external guide rollers 70*a* and said plurality of internal guide rollers 70*b*. In a preferred embodiment illustrated in FIGS. 1, 2, 3, 4 and 5, said hydraulic drive motor 160 attaches to a main drive shaft 170 and operates to: rotate said main drive shaft 170 about its vertical axis; thereby rotate a drive shaft pneumatic drive wheel 165*a* rigidly connected to said main drive shaft 170 by means of a lower main drive shaft keyed connection 175, an upper hub collar 180, and a lower hub collar 185; and rotate a dual drive belt pulley 190 rigidly attached to said main drive shaft 170 by means of an upper main drive shaft keyed connection 195 and a drive shaft coupler 200. drive belt 205*b* to a right remote drive pulley 210*b* (shown in FIG. 4). As seen in FIGS. 3 and 4, said left remote drive pulley 210*a* is rigidly attached to a left remote drive shaft 215*a* by means of an upper left remote drive shaft keyed connection 220*a* and said right remote drive pulley 210*b* is likewise rigidly attached to a right remote drive shaft 215*b* by means of an upper right remote drive shaft keyed connection 220*b*. Said left remote drive shaft 215*a* is rigidly attached to a left pneumatic drive wheel 165*b* by means of a lower left remote drive shaft keyed connection 225*a*, a left remote drive shaft upper hub collar 230*a* and a left remote drive shaft lower hub collar 235*a*. Said right remote drive shaft 215*b* is likewise rigidly attached to a right pneumatic drive wheel 165*c* by means of a lower right remote drive shaft keyed connection 225*b*, a right remote drive shaft upper hub collar 230*b* and a right remote drive shaft lower hub collar 235*b*. Being thus operatively connected with said hydraulic drive motor 160, said left pneumatic drive wheel 165*b* and said right pneumatic drive wheel 165*c*, together with said drive shaft pneumatic drive wheel 165*a*, rotate about their respective vertical axises and frictionally engage the exterior perimeter of said arcuate guide 150 moving said arcuate guide 150 around its circular orbit.

Figure 5:
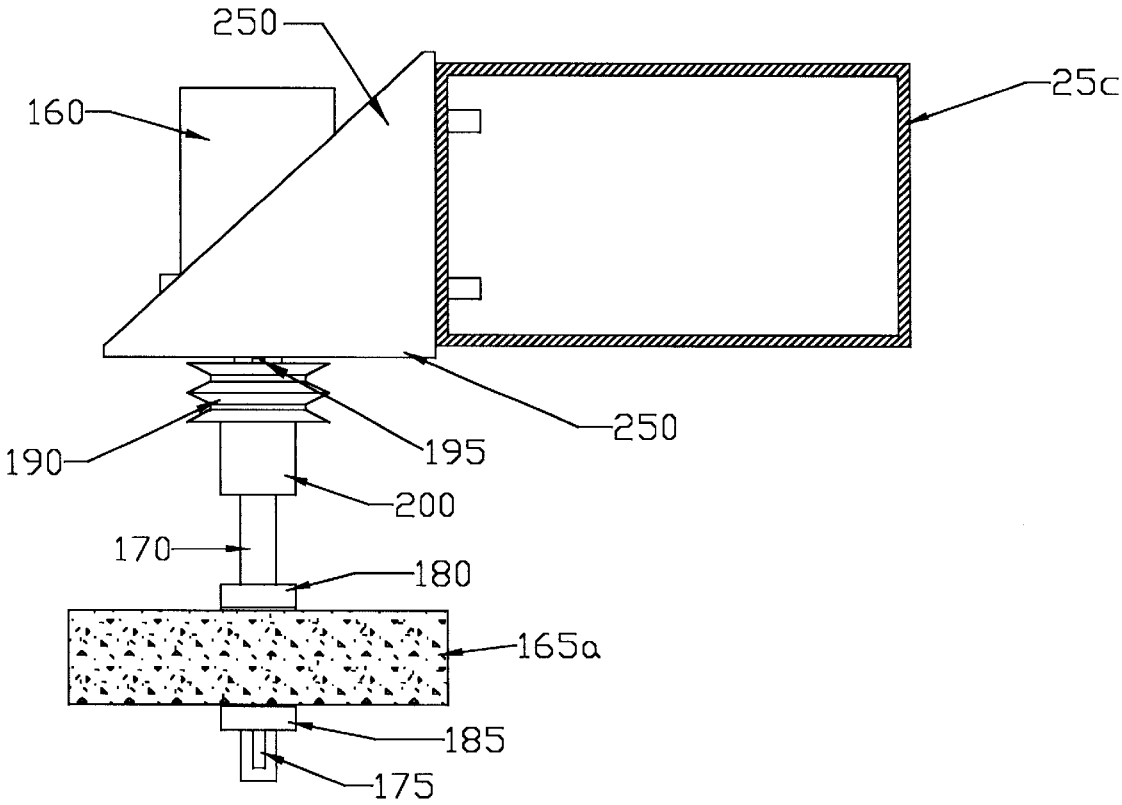
FIG. 5 is a sectional view taken through line 5—5 of FIG. 1 and line 5—5 of FIG. 2.

Referring further to FIG. 3, said left remote drive shaft 215*a* is rotatably connected to a left wheel bearing 240*a*, at an end opposite its connection with said left pneumatic wheel 165*b*, and said left wheel bearing 240*a* is ridgedly attached to a left bearing backing plate 245*a*. Said left bearing backing plate 245*a* is rigidly attached to said left horizontal support member 25*b*. Referring to FIG. 4, said right remote drive shaft 215*b* is likewise rotatably connected to a right wheel bearing 240*b*, at an end opposite its connection with said right pneumatic wheel 165*c*, and said right wheel bearing 240*b* is ridgedly attached to a right bearing backing plate 245*b*. Said right bearing backing plate 245*b* is rigidly attached to said right horizontal support member 25*d*. Referring further to FIG. 5, said hydraulic drive motor 160 is rigidly mounted to a motor mounting bracket 250 and said motor mounting bracket 250 is, in turn, rigidly mounted to said center horizontal support member 25*c*.

As illustrated in FIG. 1, the tension in said left drive belt 205*a* may be adjusted by means of a left drive belt tightening pulley 255*a* which frictionally engages said left drive belt 205*a* and rotatably connects to a left drive belt tightening pulley mounting bracket 260*a*, said left drive belt tightening pulley mounting bracket 260*a* extending radially inward to a rigid connection with said arcuate frame 30. The tension in said right drive belt 205*b* may likewise be adjusted by means of a right drive belt tightening pulley 255*b* which frictionally engages said right drive belt 205*b* and rotatably connects to a right drive belt tightening pulley mounting bracket 260*b*, said right drive belt tightening pulley mounting bracket 260*b* extending radially inward to a rigid connection with said arcuate frame 30.

Figure 11:
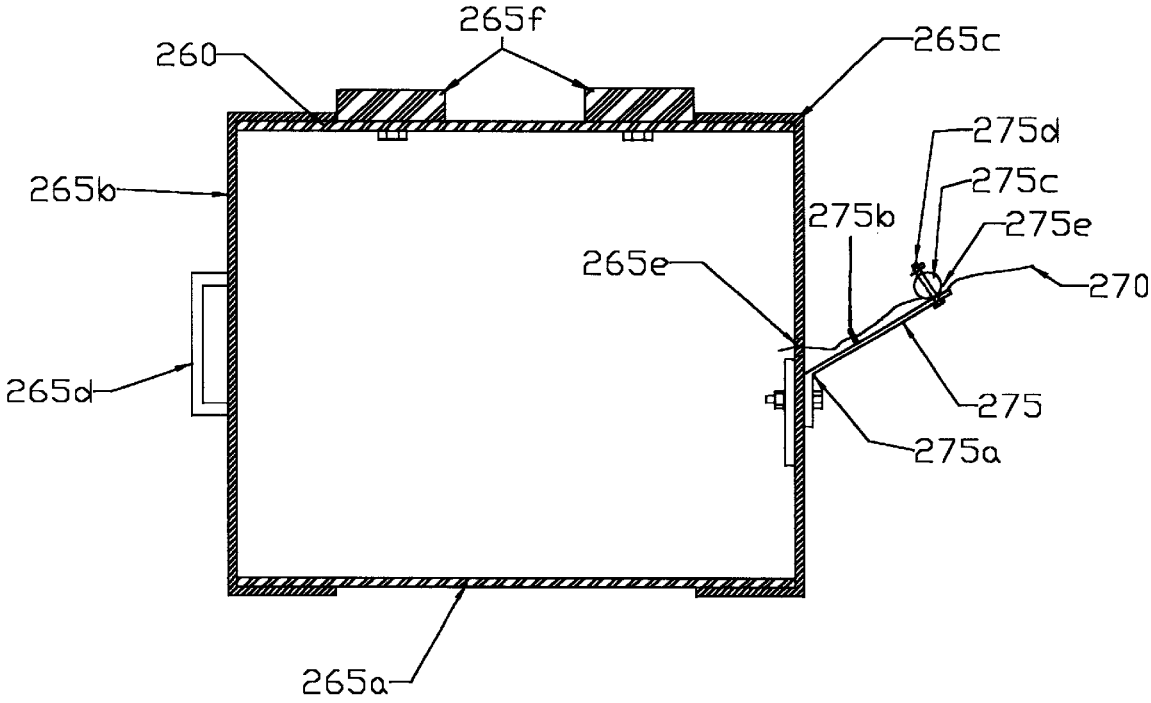
FIG. 11 is a sectional view taken through line 11—11 of FIG. 2.

Referring to FIGS. 2 and 11, a twine dispenser 265 is operatively attached to said arcuate guide 150 and dispenses twine 270 through a twine tensioning device 275 as said arcuate guide 150 is rotated in its orbit about said vertical channel 35 containing said standing tree. Referring specifically to a preferred embodiment set forth in FIG. 11, said twine dispenser comprises a hollow twine container 265*a* having two caps 265*b*, 265*c*, a first cap 265*b* having an external handle 265*d* thereon and being removably connected to a first end of said twine container 265*a* and a second cap 265*c* being rigidly connected to a second end of said twine container 265*a* opposite said first end of said twine container 265*a* and having a twine dispensing hole 265*e* therethrough. Said twine container 265*a* is boltedly attached to one or more twine dispenser supports 265*f*, each of said twine dispenser supports 265*f* extending away from said twine container 265*a* to an opposite end of said twine dispenser support 265*f* which rigidly attaches to said arcuate guide 150.

In a preferred embodiment illustrated by FIG. 11, twine is dispensed from a coil of twine (not shown) contained within said twine container 265*a* through said twine dispensing hole 265*e* and is tensioned for placement about said standing tree by said twine tensioning device 275, said twine tensioning device 275 comprising: a rigid tailed-plate member 275*a* boltedly connected at a plate portion thereof to the exterior perimeter of said second cap 265*c* at an area proximate to said twine dispensing hole 265*e*, and with a tailed portion of said tailed-plate member 275*a* extending diagonally away from a junction between said tailed portion and said plate portion of said tailed-plate member 275*a* in a direction away from said twine dispenser 265; a ringed guide member 275*b* rigidly attached to an engaging side of said tailed portion of said tailed-plate member 275*a*; a twine compression member 275*c* boltedly connected to said engaging side of said tailed portion of said tailed-plate member 275*a* at an area on said engaging side further away from said plate portion than said ringed guide member's 275*b* attachment to said engaging side of said tailed portion of said tailed-plate member 275*a*; and a twine compression member adjustment nut 275*d* rotatably connected to said twine compression member's 275*c* bolted connection with said tailed-plate member 275*a*, said twine compression member adjustment nut 275*d* being rotatably adjustable to vary tensioning force applied to said twine 270 as said twine 270 passes through a compressible passageway 275*e* between said twine compression member 275*c* and the tailed portion of said tailed-plate member 275*a*. Twine 270 emerging from the twine dispensing hole 265*e* feeds through the ringed guide member 275*b* and is tensioned as it passes between, and is compressed and frictionally engaged by, said twine compression member 275*c* and said tailed-plate member 275*a* for placement around said standing tree.

In operation, the apparatus 10 is first moved forward for lateral engagement about said standing tree and said trunk of said tree is guided through said horizontal channel 40 into said vertical channel 35 for baling. After said tree has been substantially centered in said vertical channel 35 and the twine 270 used for binding anchored relative to said trunk or a lower limb of said tree, said lifting device 20 operatively connected to said apparatus 10 and comprising a liftable portion of a lift truck, a skid steer loader, a forklift, a wheel loader, a tractor, a backhoe, a trackhoe or other equivalent means for lifting said apparatus 10, gradually elevates the apparatus 10 from the lower solid line position illustrated in FIG. 12 to the upper phantom line position thereof illustrated in FIG. 12. As said apparatus 10 is gradually elevated, branches of said tree are compressed toward said trunk of said tree by said plurality of compression rollers 45.

Figure 12:
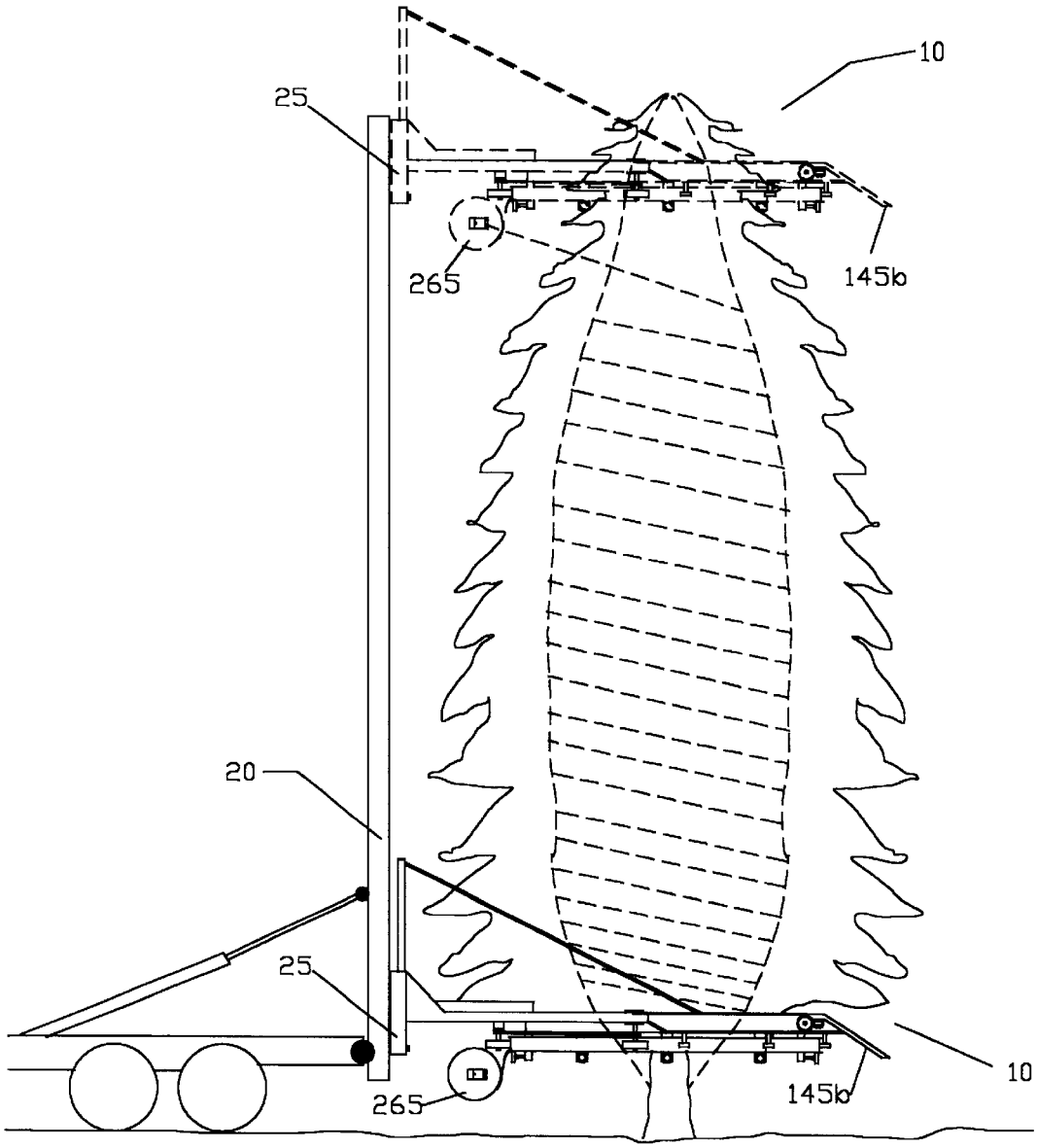
FIG. 12 is an elevated horizontal plan view from the right of the tree compression and binding apparatus of the present invention operatively associated with a standing tree and an upper position of said apparatus and said tree in baled condition illustrated in phantom lines.

As said apparatus 10 is gradually elevated, said rotatable arcuate guide 150 having said twine dispenser 265 and said twine tensioning device 275 operatively connected thereto, are rotated through complete circular orbits about said vertical channel 35 by said assembly and means for rotating, dispensing said twine 270 throughout each orbit and thereby helically binding (baling) said standing tree as illustrated by the phantom helical lines in FIG. 12. Said rotating arcuate guide 150 with said twine dispenser 265 and twine tensioning device 275 attached thereto, together with the twine 270 dispensed from said twine dispenser 265 accordingly comprise an assembly and means for binding a plurality of branches around said trunk of said standing tree while said plurality of branches are compressed toward said trunk.

As said apparatus 10 reaches its uppermost position relative to said standing tree being baled denoted by the upper phantom line position thereof illustrated in FIG. 12, said assembly and means for rotating said arcuate guide 150 around said vertical channel 35 are disengaged and said arcuate guide 150 is returned to the orientation it occupied relative to the arcuate frame 30 at the time said tree was laterally engaged for baling. At the same time or shortly thereafter, said assembly and means for selectively gating said horizontal channel 40 are disengaged, reopening said horizontal channel 40. The apparatus 10 is then drawn away from said tree, with said tree exiting said apparatus 10 through said horizontal channel 40. The apparatus 10 is then lowered to the horizontal position it occupied when it first laterally engaged the tree. In that position, the twine 270 may be cut and tied about the bottom of said tree and the apparatus 10 is ready to laterally engage a next tree for baling without further manipulation.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention. The materials used in construction of said tree compression and binding apparatus are metallic elements, metallic alloys, and polymers which provide strength, durability and rust resistance.

What is claimed is:

1. An apparatus for engaging a standing tree, compressing a plurality of branches of said tree toward a trunk of said tree, and binding said plurality of branches around said trunk while said plurality of branches are thus compressed, comprising:

a) a support structure attached to a rigid horizontal arcuate frame, said arcuate frame partially circumscribing a vertical channel occupiable by said standing tree and said arcuate frame further having a horizontal channel therethrough through which said tree enters into said vertical channel when said tree is laterally engaged for baling and through which said tree exits at conclusion of baling;

b) means for compressing said plurality of branches of said standing tree toward said trunk of said tree;

c) a horizontal arcuate guide operatively connected to said arcuate frame, said arcuate guide partially circumscribing said vertical channel, said arcuate guide further having a horizontal passageway therethrough through which said standing tree enters into said vertical channel when said tree is laterally engaged for baling and through which said tree exits at the conclusion of baling;

d) an assembly for rotating said arcuate guide in a complete orbit around said vertical channel, said assembly for rotating comprising a drive motor operatively connected to a plurality of rotatable drive wheels, said plurality of rotatable drive wheels being frictionally enpayable with a perimeter of said arcuate guide and said arcuate guide being rotatably mounted upon a plurality of carrier rollers, said plurality of carrier rollers being disposed at points along a path beneath said arcuate frame with a carrier roller among said plurality of carrier rollers being rotatable around a horizontal axis and being operatively connected to said arcuate frame and said arcuate guide being rotatable mounted between a plurality of external guide rollers and a plurality of internal guide rollers with said plurality of external guide rollers and said plurality of internal guide rollers being operatively connected to said arcuate frame;

e) means for binding said plurality of branches of said standing tree around said trunk of said tree while said plurality of branches are compressed.

2. An apparatus as in claim 1, wherein said arcuate frame comprises a single main body rigidly attached to a plurality of arcuate frame reinforcement members and said support structure comprises a left horizontal support member rigidly attached to said arcuate frame, a right horizontal support member rigidly attached to said arcuate frame, a left diagonal support member rigidly attached to said arcuate frame, a right diagonal support member rigidly attached to said arcuate frame and a center horizontal support member rigidly attached to said arcuate frame.

3. An apparatus as in claim 2, wherein said main body of said arcuate frame comprises a metallic rectangular tube.

4. An apparatus as in claim 1, wherein said means for compressing said plurality of branches of said standing tree toward said trunk of said tree comprise a plurality of cylindric horizontal compression rollers spaced to an interior side of an interior perimeter of said arcuate frame with each compression roller among said plurality of compression rollers being operatively connected to said arcuate frame and being rotatable around a horizontal axis.

5. An apparatus as in claim 1, wherein each drive wheel among said plurality of drive wheels is pneumatic.

6. An apparatus as in claim 1, wherein said plurality of drive wheels comprise:

a) a drive shaft pneumatic drive wheel rigidly connected by a lower main drive shaft keyed connection, by an upper hub collar and by a lower hub collar to a main drive shaft, said main drive shaft being attached to said drive motor and being rotatable by said drive motor about a vertical axis;

b) a left pneumatic drive wheel rigidly connected by a lower left remote drive shaft keyed connection, a left remote drive shaft upper hub collar and a left remote drive shaft lower hub collar to a left remote drive shaft, said left remote drive shaft being rigidly attached by an upper left remote drive shaft keyed connection to a left remote drive pulley, said left remote drive pulley being beltedly connected to a dual drive belt pulley, said dual drive belt pulley being rigidly attached to said main drive shaft by an upper main drive shaft keyed connection and a drive shaft coupler, and said left pneumatic drive wheel being rotatable around a vertical axis as said main drive shaft is rotated; and c) a right pneumatic drive wheel rigidly connected by a lower right remote drive shaft keyed connection, a right remote drive shaft upper hub collar and a right remote drive shaft lower hub collar to a right remote drive shaft, said right remote drive shaft being rigidly attached by an upper right remote drive shaft keyed connection to a right remote drive pulley, said right remote drive pulley being beltedly connected to said dual drive belt pulley, and said right pneumatic drive wheel being rotatable around a vertical axis as said main drive shaft is rotated.

7. An apparatus as in claim 1, wherein a carrier roller among said plurality of carrier rollers is rotatably connected to a carrier bolting mechanism inserted through a hole in said carrier roller and rigidly connecting to a carrier mounting bracket, said carrier mounting bracket proceeding upward in a vertical direction from said connection with said carrier bolting mechanism and rigidly connecting at an upper end of said carrier mounting bracket to a lower perimeter of said arcuate frame.

8. An apparatus as in claim 7, wherein said plurality of external guide rollers are disposed at points along an arcuate path beneath said arcuate frame and said plurality of internal guide rollers are disposed at points along a second, parallel arcuate path beneath said arcuate frame, with an external guide roller among said plurality of external guide rollers being rotatable around a vertical axis and being operatively connected to a vertical external guide bolting mechanism inserted through a hole in a horizontal external guide mounting bracket, with said external guide mounting bracket proceeding radially inward from said connection with said external guide bolting mechanism and rigidly connecting at an inner end of said external guide mounting bracket to an exterior perimeter of said arcuate frame and with an internal guide roller among said plurality of internal guide rollers being rotatable around a vertical axis and being rotatably connected to a vertical internal guide bolting mechanism inserted through a hole in a horizontal internal guide mounting bracket, said internal guide mounting bracket proceeding radially inward from said hole in said internal guide mounting bracket and connecting to said carrier mounting bracket, said carrier mounting bracket proceeding upward in a vertical direction from said connection with said internal guide mounting bracket and rigidly connecting at an upper end of said carrier mounting bracket to said lower perimeter of said arcuate frame.

9. An apparatus as in claim 1, wherein said means for binding said plurality of branches of said standing tree around said trunk of said tree while said plurality of branches are compressed comprises:

a) said arcuate guide;

b) said assembly for rotating said arcuate guide in a complete orbit around said vertical channel;

c) a twine dispenser containing twine, said twine dispenser being operatively connected to said arcuate guide and being rotatable in a complete orbit around said vertical channel; and d) a twine tensioning device operatively connected to said twine dispenser, said twine tensioning device being rotatable in a complete orbit around said vertical channel.

10. An apparatus as in claim 9, wherein said twine dispenser comprises a hollow twine container, said twine container having a first cap removably attached to a first end of said twine container with said first cap having an external handle attached thereto and said twine container further having a second cap attached to a second end of said twine container, said second end being opposite said first end of said twine container and said second cap of said twine container having a twine dispensing hole therethrough, said twine dispenser being operatively attached to said arcuate guide.

11. An apparatus for engaging a standing tree, compressing a plurality of branches of said tree toward a trunk of said tree, and binding said plurality of branches around said trunk while said plurality of branches are thus compressed, comprising:

a) a support structure attached to a rigid horizontal arcuate frame, said arcuate frame partially circumscribing a vertical channel occupiable by said standing tree and said arcuate frame further having a horizontal channel therethrough through which said tree enters into said vertical channel when said tree is laterally engaged for baling and through which said tree exits at conclusion of baling;

b) means for compressing said plurality of branches of said standing tree toward said trunk of said tree;

c) a horizontal arcuate guide operatively connected to said arcuate frame, said arcuate guide partially circumscribing said vertical channel, said arcuate guide further having a horizontal passageway therethrough through which said standing tree enters into said vertical channel when said tree is laterally engaged for baling and through which said tree exits at the conclusion of baling;

d) means for rotating said arcuate guide in a complete orbit around said vertical channel;

e) means for binding said plurality of branches of said standing tree around said trunk of said tree while said plurality of branches are compressed; and f) an assembly for selectively gating said horizontal channel, said assembly for selectively gating comprising a horizontal gate said gate being selectively movable from an open position wherein said horizontal channel is maintained to a closed position wherein said sate occupies a gate passageway of a gate sleeve, continues through said horizontal channel and into a gate coupling passageway of a gate coupling sleeve.

12. An apparatus for engaging a standing tree, compressing a plurality of branches of said tree toward a trunk of said tree, and binding said plurality of branches around said trunk while said plurality of branches are thus compressed, comprising:

a) a support structure attached to a rigid horizontal arcuate frame, said arcuate frame partially circumscribing a vertical channel occupiable by said standing tree and said arcuate frame further having a horizontal channel therethrough through which said tree enters into said vertical channel when said tree is laterally engaged for baling and through which said tree exits at conclusion of baling;

b) means for compressing said plurality of branches of said standing tree toward said trunk of said tree;

c) a horizontal arcuate guide operatively connected to said arcuate frame, said arcuate guide partially circumscribing said vertical channel, said arcuate guide further having a horizontal passageway therethrough through which said standing tree enters into said vertical channel when said tree is laterally engaged for baling and through which said tree exits at the conclusion of baling;

d) means for rotating said arcuate guide in a complete orbit around said vertical channel;

e) means for binding said plurality of branches of said standing tree around said trunk of said tree while said plurality of branches are compressed;

f) means for selectively gating said horizontal channel; and g) an assembly for guiding said trunk of said standing tree through said horizontal channel and displacing a plurality of branches of said tree from a horizontal path in front of said apparatus during lateral engagement of said apparatus around said tree comprising a limb guide, said limb guide having a plurality of limb guide lifting members operatively connected to said arcuate frame.

13. An apparatus for engaging a standing tree, compressing a plurality of branches of said tree toward a trunk of said tree, and binding said plurality of branches around said trunk while said plurality of branches are thus compressed, comprising:

a) a support structure attached to a rigid horizontal arcuate frame, said arcuate frame partially circumscribing a vertical channel occupiable by said standing tree and said arcuate frame further having a horizontal channel therethrough through which said tree enters into said vertical channel when said tree is laterally engaged for baling and through which said tree exits at conclusion of baling;

b) means for compressing said plurality of branches of said standing tree toward said trunk of said tree;

c) a horizontal arcuate guide operatively connected to said arcuate frame, said arcuate guide partially circumscribing said vertical channel, said arcuate guide further having a horizontal passageway therethrough through which said standing tree enters into said vertical channel when said tree is laterally engaged for baling and through which said tree exits at the conclusion of baling;

d) means for rotating said arcuate guide in a complete orbit around said vertical channel;

e) an assembly for binding said plurality of branches of said standing tree around said trunk of said tree while said plurality of branches are compressed; and f) an assembly for selectively gating said horizontal channel comprising:

i) a tubular horizontal gate sleeve disposed laterally away from said horizontal channel, said gate sleeve having a gate passageway therethrough and further having an end bordering a first side of said horizontal channel, said gate sleeve being rigidly attached to said arcuate frame;

ii) a tubular horizontal gate coupling sleeve disposed laterally away from said horizontal channel, said gate coupling sleeve having a gate coupling passageway therethrough and further having an end bordering said horizontal channel on a second side of said horizontal channel, said second side being opposite said first side of said horizontal channel, and said gate coupling sleeve being rigidly attached to said arcuate frame;

iii) a horizontal gate disposed medially toward and into said gate passageway of said gate sleeve, said horizontal gate being movable from an open position wherein said horizontal channel is maintained to a closed position wherein said gate occupies said gate passageway of said gate sleeve, continues through said horizontal channel and into said gate coupling passageway of said gate coupling sleeve; and iv) a hydraulic ram, said hydraulic ram being operatively attached at a first end to said gate sleeve and being operatively attached at a second, opposite end to said gate, said hydraulic ram being operatively connected with a hydraulic motor, and said hydraulic ram selectively drawing said gate from said open position to said closed position and back to said open position as directed.

14. An apparatus for engaging a standing tree, compressing a plurality of branches of said tree toward a trunk of said tree, and binding said plurality of branches around said trunk while said plurality of branches are thus compressed, comprising:

a) a support structure attached to a rigid horizontal arcuate frame, said arcuate frame partially circumscribing a vertical channel occupiable by said standing tree and said arcuate frame further having a horizontal channel therethrough through which said tree enters into said vertical channel when said tree is laterally engaged for baling and through which said tree exits at conclusion of baling;

b) an assembly for compressing said plurality of branches of said standing tree toward said trunk of said tree comprising a plurality of cylindric horizontal compression rollers spaced to an interior side of an interior perimeter of said arcuate frame with a compression roller among said plurality of compression rollers being operatively connected to said arcuate frame and being rotatable around a horizontal axis;

c) a horizontal arcuate guide operatively connected to said arcuate frame, said arcuate guide partially circumscribing said vertical channel, said arcuate guide further having a horizontal passageway therethrough through which said standing tree enters into said vertical channel when said tree is laterally engaged for baling and through which said tree exits at the conclusion of baling;

d) means for rotating said arcuate guide in a complete orbit around said vertical channel; and e) means for binding said plurality of branches of said standing tree around said trunk of said tree while said plurality of branches are compressed; and wherein a compression roller among said plurality of compression rollers is rotatably connected at a first end to a first spinner tab by means of a first compression roller bolting mechanism inserted through a hole in said first spinner tab and boltedly connected to a first bearing insert in a first compression roller insert, said first compression roller insert being attached to said first end of said compression roller and said first spinner tab proceeding outward from its rotatable connection with said first compression roller bolting mechanism in a direction perpendicular to the horizontal axis of said compression roller and in the same horizontal plane as said compression roller and rigidly connecting at a first attachment area on the interior perimeter of said arcuate frame and said compression roller is rotatably connected at an opposite end to a second spinner tab by means of a second compression roller bolting mechanism inserted through a hole in said second spinner tab and boltedly connected to a second bearing insert in a second compression roller insert, said second compression roller insert being attached to said opposite end of said compression roller and said second spinner tab proceeding outward from its rotatable connection with said second compression roller bolting mechanism in a direction perpendicular to the horizontal axis of said compression roller and in the same horizontal plane as said compression roller and rigidly connecting at a second attachment area on the interior perimeter of said arcuate frame.

15. An apparatus for engaging a standing tree, compressing a plurality of branches of said tree toward a trunk of said tree, and binding said plurality of branches around said trunk while said plurality of branches are thus compressed, comprising:

a) a support structure attached to a rigid horizontal arcuate frame, said arcuate frame partially circumscribing a vertical channel occupiable by said standing tree and said arcuate frame further having a horizontal channel therethrough through which said tree enters into said vertical channel when said tree is laterally engaged for baling and through which said tree exits at conclusion of baling;

b) Means for compressing said plurality of branches of said standing tree toward said trunk of said tree;

c) a horizontal arcuate guide operatively connected to said arcuate frame, said arcuate guide partially circumscribing said vertical channel, said arcuate guide further having a horizontal passageway therethrough through which said standing tree enters into said vertical channel when said tree is laterally engaged for baling and through which said tree exits at the conclusion of baling;

d) means for rotating said arcuate guide in a complete orbit around said vertical channel; and e) an assembly for binding said plurality of branches of said standing tree around said trunk of said tree while said plurality of branches are compressed, said assembly for binding comprising:

i) said arcuate guide;

ii) said means for rotating said arcuate guide in a complete orbit around said vertical channel;

iii) a twine dispenser containing twine, said twine dispenser being operatively connected to said arcuate guide and being rotatable in a complete orbit around said vertical channel, said twine dispenser comprising a hollow twine container, said twine container having a first cap removably attached to a first end of said twine container with said first cap having an external handle attached thereto and said twine container further having a second cap attached to a second end of said twine container, said second end being opposite said first end of said twine container and said second cap of said twine container having a twine dispensing hole therethrough, said twine dispenser being operatively attached to said arcuate guide; and iv) a twine tensioning device operatively connected to said twine dispenser, said twine tensioning device being rotatable in a complete orbit around said vertical channel and comprising:

a) a tailed-plate member connected at a plate portion thereof to said second cap of said twine dispenser, said plate portion thereof being proximate to said twine dispensing hole and said tailed-plate member further having a tailed portion, said tailed portion extending diagonally away from a junction between said tailed portion and said plate portion of said tailed-plate member in a direction away from said twine dispenser;

b) a ringed guide member rigidly attached to an area on an engaging side of said tailed portion of said tailed-plate member;

c) a twine compression member, said twine compression member being connected by a bolted connection to said engaging side of said tailed portion of said tailed-plate member at a second area of said engaging side of said tailed portion more distant from said plate portion than said area where said ringed guide member attaches to said tailed portion, said twine compression member tensionally engaging said twine as said twine passes through a compressible passageway between said twine compression member and said tailed portion of said tailed-plate member; and d) a twine compression member adjustment nut, said adjustment nut being rotatably connected to said compression member's bolted connection with said tailed-plate member, said adjustment nut being rotatably adjustable to vary tensioning force applied to said twine as said twine passes through said compressible passageway between said twine compression member and said tailed portion of said tailed-plate member for placement around said standing tree.

* * * * *

UNITED STATES PATENT AND TRADEMARK OFFICE

CERTIFICATE OF CORRECTION

PATENT NO. : 6,622,620 B1
DATED : September 23, 2003
INVENTOR(S) : Shain Byington It is certified that error appears in the above-identified patent and that said Letters Patent is hereby corrected as shown below:

Column 11,
Line 52, "empayable" is hereby deleted and replaced with the term -- engagable --.

Signed and Sealed this

Twentieth Day of January, 2004

JON W. DUDAS
*Acting Director of the United States Patent and Trademark Office*